US011004622B2

(12) United States Patent
Meyer et al.

(10) Patent No.: US 11,004,622 B2
(45) Date of Patent: May 11, 2021

(54) ON-LOAD TAP CHANGER

(71) Applicant: Maschinenfabrik Reinhausen GmbH, Regensburg (DE)

(72) Inventors: Markus Meyer, Hemau (DE); Christian Kotz, Schorndorf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 16/080,677

(22) PCT Filed: Mar. 8, 2017

(86) PCT No.: PCT/EP2017/055392

§ 371 (c)(1),
(2) Date: Aug. 29, 2018

(87) PCT Pub. No.: WO2017/153448

PCT Pub. Date: Sep. 14, 2017

(65) Prior Publication Data

US 2019/0066940 A1 Feb. 28, 2019

(30) Foreign Application Priority Data

Mar. 11, 2016 (DE) ..... 10 2016 104 500.4

(51) Int. Cl.
*H01H 9/00* (2006.01)

(52) U.S. Cl.
CPC ..... *H01H 9/0027* (2013.01); *H01H 9/0016* (2013.01); *H01H 9/0038* (2013.01); *H01H 9/0044* (2013.01)

(58) Field of Classification Search
CPC ... H01H 9/0027; H01H 9/0016; H01H 9/0038
USPC ..... 323/256
See application file for complete search history.

(56) References Cited

U.S. PATENT DOCUMENTS

| | | | | |
|---|---|---|---|---|
| 2,785,242 | A | 3/1957 | White | |
| 6,060,669 | A | 5/2000 | Dohnal et al. | |
| 2006/0244431 | A1 | 11/2006 | Dohnal et al. | |
| 2012/0241300 | A1 | 9/2012 | Brasher et al. | |
| 2013/0112541 | A1* | 5/2013 | Albrecht | H01H 9/0027 200/564 |
| 2015/0034462 | A1 | 2/2015 | Bieringer et al. | |
| 2015/0068877 | A1* | 3/2015 | Hoepfl | H01H 3/42 200/11 TC |
| 2015/0171783 | A1 | 6/2015 | Kammerl et al. | |

(Continued)

FOREIGN PATENT DOCUMENTS

| | | | |
|---|---|---|---|
| DE | 2529381 | A1 | 1/1977 |
| DE | 19957013 | C1 | 12/2000 |
| DE | 102012104378 | A1 | 7/2013 |

(Continued)

*Primary Examiner* — Edwin A. Leon
*Assistant Examiner* — Iman Malakooti
(74) *Attorney, Agent, or Firm* — Leydig, Voit & Mayer, Ltd.

(57) ABSTRACT

An on-load tap changer of a resistor type includes a selector base plate; a selector mounted on the selector base plate; a diverter switch base plate; a diverter switch mounted on the diverter switch base plate and having a transition resistor; and a common drive shaft which is configured to actuate the selector and the diverter switch.

10 Claims, 8 Drawing Sheets

(56) References Cited

U.S. PATENT DOCUMENTS

2016/0181025 A1* 6/2016 Hoepfl ..... H01H 9/0016
200/11 TC

FOREIGN PATENT DOCUMENTS

| | | | |
|---|---|---|---|
| DE | 202012101475 | U1 | 7/2013 |
| DE | 102013107545 | A1 | 1/2015 |
| EP | 1215694 | A2 | 6/2002 |
| JP | S58111229 | A | 7/1983 |
| JP | H0582366 | A | 4/1993 |
| JP | 2012238653 | A | 12/2012 |
| WO | WO 2004088693 | A1 | 10/2004 |
| WO | WO 2013185961 | A1 | 12/2013 |

* cited by examiner

ON-LOAD TAP CHANGER

CROSS-REFERENCE TO PRIOR APPLICATIONS

This application is a U.S. National Stage Application under 35 U.S.C. § 371 of International Application No. PCT/EP2017/055392 filed on Mar. 8, 2017, and claims benefit to German Patent Application No. DE 10 2016 104 500.4 filed on Mar. 11, 2016. The International Application was published in German on Sep. 14, 2017, as WO 2017/153448 A1 under PCT Article 21(2).

FIELD

The invention relates to an on-load tap changer.

BACKGROUND

On-load tap changers of the resistor type are generally constructed in accordance with two alternative basic principles, either as a so-called load selector or as a diverter switch with a selector. DE 10 2013 107 545 A1 describes a load selector which performs selection of the desired new step contact and switching over from the instantaneous current-conducting old step contact to the new step contact in a slide movement under load. In that case, the diverter switch insert, which carries out the transfer and on which the vacuum interrupters, the movable contacts and the resistors are mounted, is rotatably arranged in a sealed oil vessel.

DE 25 29 381 C3 describes an on-load tap changer in which initially the selection is carried out, without load, relatively slowly by a selector and subsequently switching-over as quickly as possible, under load, by a diverter switch. Selector and diverter switch are two physically separate subassemblies. In that case, the diverter switch together with its switch-over resistances and switching contacts is accommodated in a separate and sealed oil vessel. The selector, which consists of a construction of insulating rods held by two cage rings, is arranged below the diverter switch in the transformer housing.

Both the load selector and the diverter switch with selector function according to the resistance fast-switching principle, in accordance with which the circuit current—which flows at the time of switching-over during the intermediate simultaneous contact with the old and new step contacts—is limited by the fact that it is conducted through resistive impedances. The longer the circuit current flows through the impedances, the more these heat up. For this reason, in the case of on-load tap changers of the prior art, the switching over is carried out as quickly as possible with the help of spring energy stores which have been stressed beforehand by a motor drive.

SUMMARY

An embodiment of the present invention provides an on-load tap changer of a resistor type that includes a selector base plate; a selector mounted on the selector base plate; a diverter switch base plate; a diverter switch mounted on the diverter switch base plate and having a transition resistor; and a common drive shaft which is configured to actuate the selector and the diverter switch.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
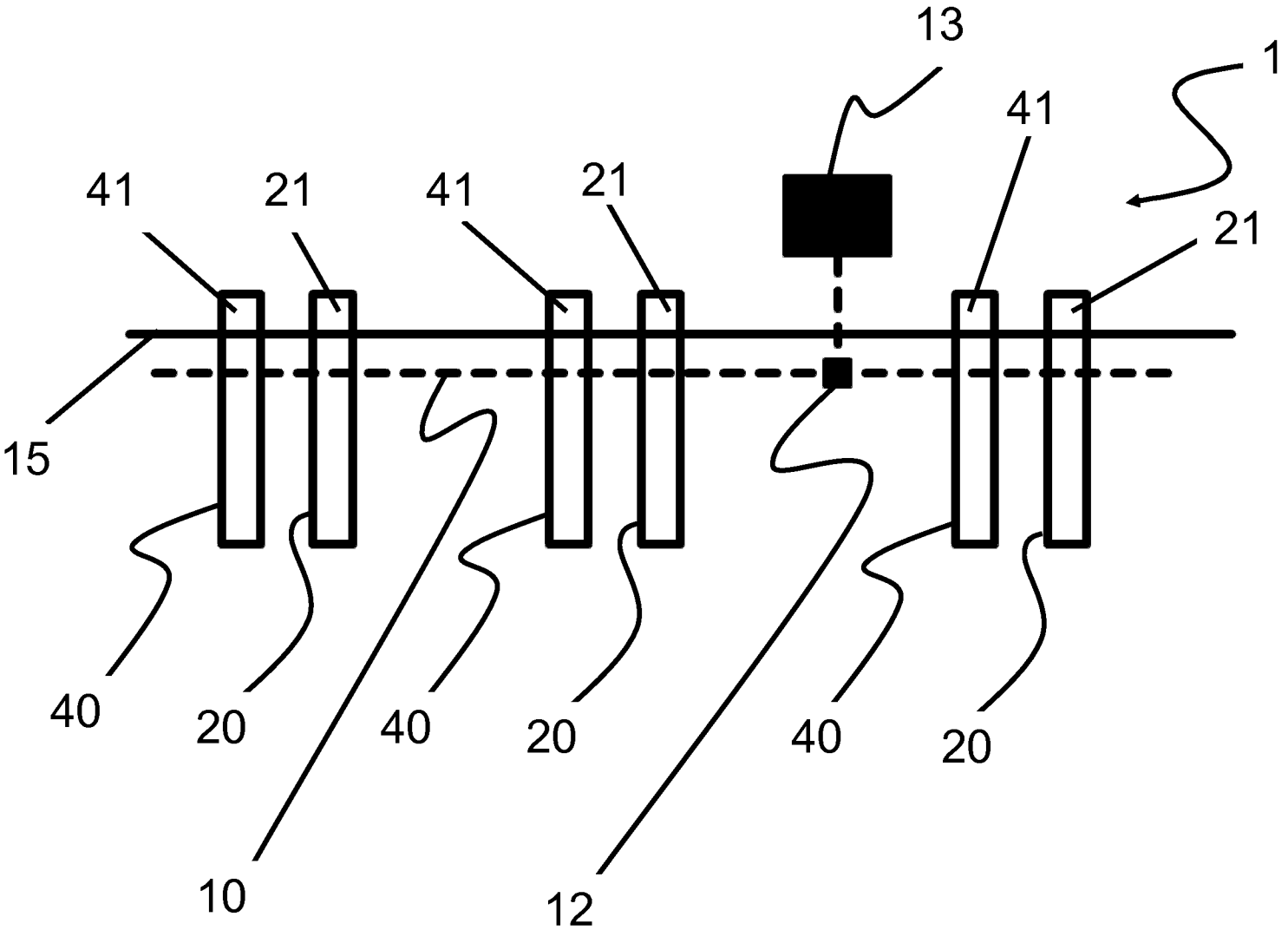
FIG. 1 shows an embodiment of a three-phase on-load tap changer according to the resistor type.

Embodiments of the present invention provide an on-load tap changer of the resistor type, which includes: a selector base plate; a diverter switch base plate; a selector mounted on the selector base plate; a diverter switch, which includes a transition resistor and which is mounted on the diverter switch base plate; and a common drive shaft which actuates and/or drives the selector and the diverter switch.

By virtue of the plate mode of construction, the on-load tap changer is economic in production, simple in assembly and reliable in operation. In that case, the diverter switch with all its parts is mounted on the diverter switch base plate and the selector with all its parts is mounted on the selector base plate. The drive shaft actuates and/or drives the diverter switch and the selector in common. Due to the particularly simple construction, it is possible to variably arrange not only the selector and the diverter switch of one phase, but also the respective phases amongst themselves at a spacing from one another depending on the respective voltage requirements.

In that case, the selector base plate and the diverter switch base plate can be constructed in any mode and manner according to requirements, for example from an insulating material such as, for example, plastic or fibre-reinforced plastic, particularly a mixture of polyamide or polyphthalamide with glass fibres.

The load transfer base plate is preferably arranged parallel to the selector base plate.

The drive shaft can be constructed in any desired mode and manner according to requirements, for example in such a way that this is constructed from one piece or from several parts.

In addition, the on-load tap changer can include a preselector which is similarly actuated and/or driven by the common drive shaft. The preselector serves the purpose of additionally switching a regulating winding in the same sense as or opposite sense to a main winding. The preselector can be arranged on the selector base plate, the on-load tap changer base plate or a separate preselector base plate.

The drive shaft can be driven directly by an electric motor. A spring energy store or an intermediate transmission can be arranged between the electric motor and the drive shaft.

The on-load tap changer can include a rod mechanically connecting the selector base plate and the load transfer switch base plate together.

In that case, use can be made of at least one additional rod or alternatively or additionally to the rods at least one spacer and/or at least one plate. The connection can also be realised by means of spacers which are injection-moulded on the selector base plate and/or the diverter switch base plate.

The on-load tap changer can include a first driver on a first side of the selector base plate; and a second driver on a second, opposite side of the selector base plate. The drive shaft actuates and/or drives the two drivers.

The on-load tap changer can include a first Geneva wheel on the first side of the selector base plate; a second Geneva wheel on the second side of the selector base plate; a plurality of fixed contacts on the first and second sides of the selector base plate; a first moved contact which is mechanically connected with the first Geneva wheel and which can be selectably connected with each of the fixed contacts on the first side; and a second moved contact which is mechanically connected with the second Geneva wheel and which can be selectably connected with each of the fixed contacts on the second side.

The fixed contacts can extend from the first side through the selector base plate to the second side.

The on-load tap changer can include a cam disc on a first side of the diverter switch base plate; and a first gearwheel on a second, opposite side of the diverter switch base plate. The drive shaft actuates and/or drives the cam disc and the first gearwheel.

The on-load tap changer can include a vacuum interrupter, which has a fixed contact and a moved contact, on the first side of the diverter switch base plate. A rocker is arranged between the moved contact and the cam disc; and the moved contact of the vacuum interrupter is actuated by way of the rocker through rotation of the cam disc.

The on-load tap changer can include a transition resistor and a switching element on the second side of the diverter switch base plate; and a second gearwheel, which has a connecting rod, between the first gearwheel and the switching element. The switching element is actuated by way of the second gearwheel and the connecting rod through rotation of the first gearwheel.

The arrangement of the individual parts, particularly vacuum interrupters, resistor and switching element can be distributed on the first and/or the second side of the diverter switch base plate according to requirements. In addition, actuation of the vacuum interrupter and the switching element can be carried out directly or by way of gearwheels, Geneva wheels or connecting rods.

The on-load tap changer can include two further selectors and two further diverter switches. The drive shaft also drives the selector and the diverter switch.

The further selectors are preferably constructed like the selector and/or the two further diverter switches are preferably constructed like the diverter switch.

The on-load tap changer can include a preselector for each selector and diverter switch, which preselector is mounted on a preselector base plate or on the respective selector base plate or on the respective diverter switch base plate and is actuated and/or driven directly or indirectly by the drive shaft.

Each preselector base plate is preferably arranged parallel to the respective selector base plate and/or the respective diverter switch base plate.

At least one of the selectors and at least one of the diverter switches and at least one of the optionally present preselectors can be associated with at least one phase of a transformer.

The on-load tap changer can include a rod which mechanically connects the selector base plates, the diverter switch base plates and the optionally present preselector base plates together.

In that case, at least one additional rod or, alternatively or additionally to the rods, at least one spacer and/or at least one plate can be used. The connection can also be realised by means of spacing devices which are injection-moulded on the selector base plates and/or the diverter switch base plates and/or the preselector base plates.

Embodiments of the present invention are explained in more detail in the following with reference to the accompanying drawings. The individual features evident therefrom are not, however, restricted to the individual forms of embodiment, but can be connected and/or combined with further above-described individual features and/or with individual features of other forms of embodiment. The details in the drawings are to be understood as merely explanatory, but not limitative.

A first embodiment of an on-load tap changer 1 of the resistor type is schematically illustrated in FIG. 1. The on-load tap changer 1 here includes three selectors 20 as well as three diverter switches 40. A specific phase of a tapped transformer is associated with each selector 20 and each diverter switch 40. A single-phase variant of the on-load tap changer 1 according to the invention would thus include only one diverter switch 40 and only one selector 20. Each selector 20 is mounted on a selector base plate 21 and each diverter switch 40 on a diverter switch base plate 41. The individual plates 21, 41 are pushed onto at least one rod 15 and are mounted by way of this. Fixing of the individual plates 21, 41 can also be realised in a different way, for example by way of spacers, webs injection-moulded in place or further plates. A common drive shaft 10 drives all selectors 20 and diverter switches 40. In this form of embodiment the drive shaft 10 extends through the individual plates 21, 41 so as to actuate the selectors 20 and diverter switches 40. The drive shaft 10 is preferably actuated by a motor 13 by way of a bevel transmission 12. The drive shaft 10 can, however, also be constructed to be actuable directly by a motor 13.

By virtue of the common drive shaft 10, the selectors 20 and diverter switches 40 are operated in such a way that load transfer from one step tap to an adjacent step tap is carried out.

Through the arrangement of the selectors 20 and the diverter switches 40 on individual separate plates 21, 41 and through the drive by way of a common drive shaft 10, it is possible to variably arrange not only the selectors 20 and the diverter switches 40 of a phase, but also the phases amongst themselves at a specific spacing from one another depending on the voltage requirements. In that case the drive shaft 10 can be constructed from one or more parts.

Figure 2:
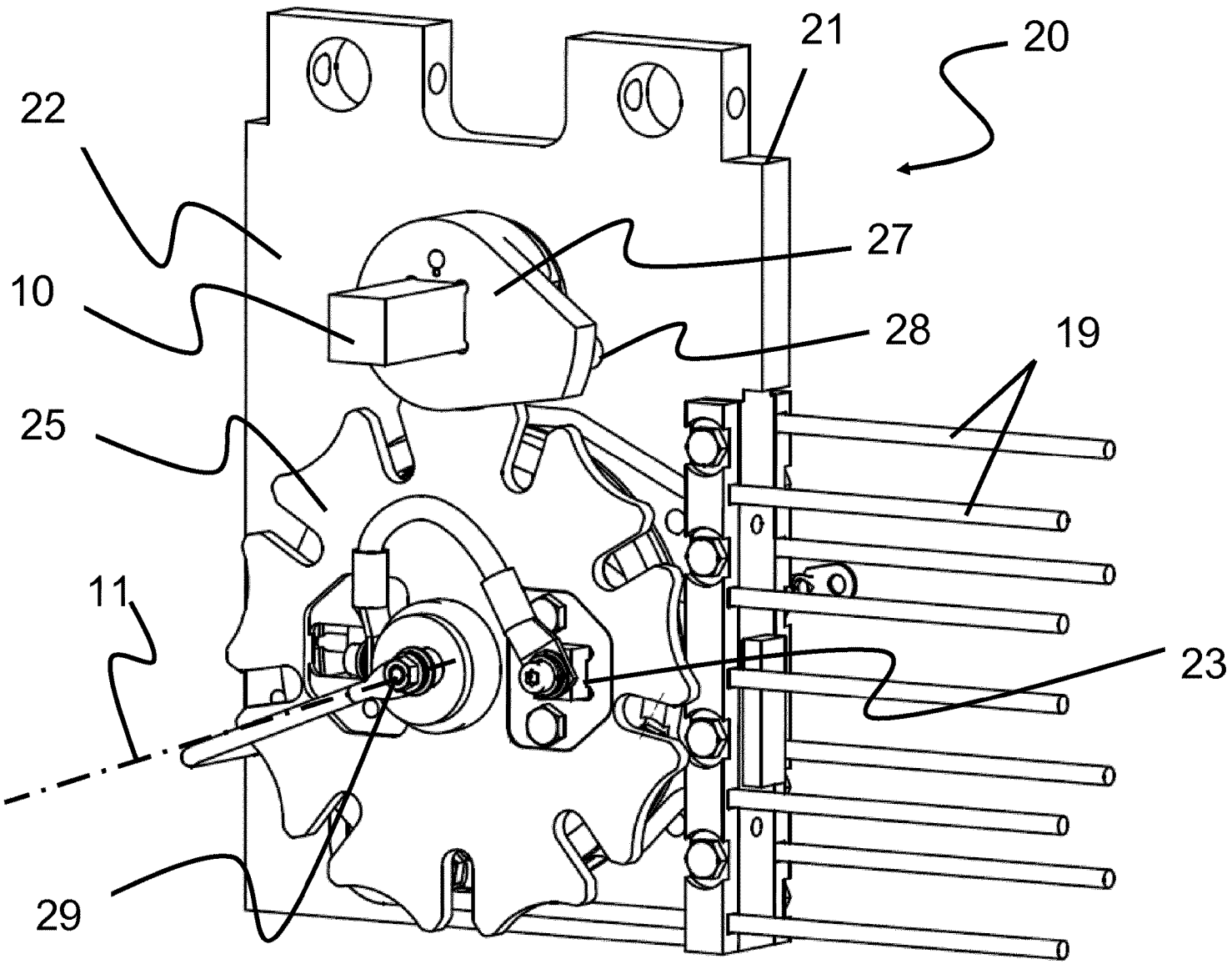
FIG. 2 shows a first side of the selector, which is constructed in accordance with a preferred form of embodiment, of the on-load tap changer.
Figure 4:
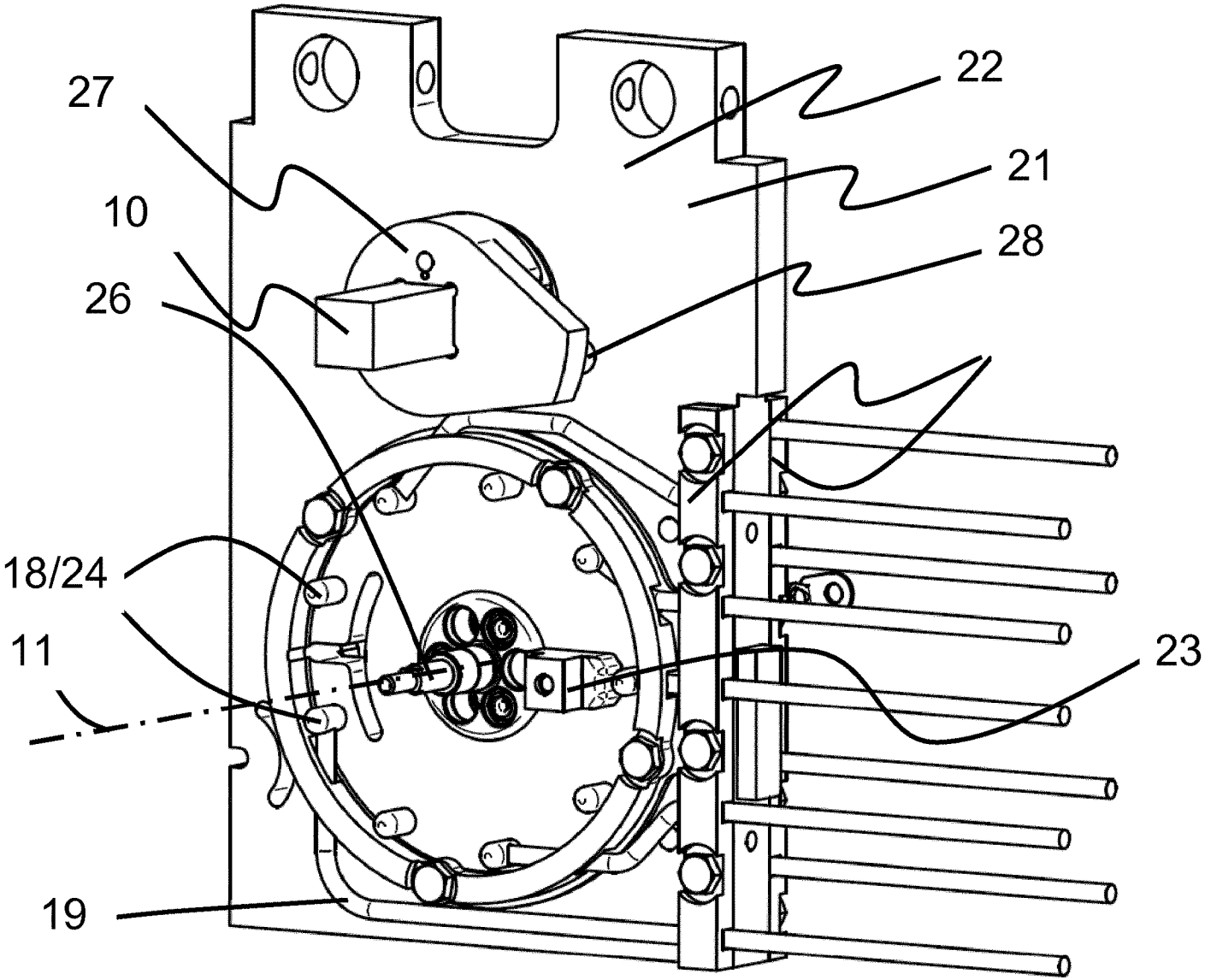
FIG. 4 shows the first side of the selector, from which a Geneva wheel has been removed.

A selector 20, which is constructed in accordance with a preferred form of embodiment, of the on-load tap changer 1 is illustrated in FIGS. 2 and 4. The selector base plate 21 preferably consists of an insulating material such as, for example, plastic or fibre-reinforced plastic (for example, a mixture of polyamide or polyphthalamide with glass fibres). The selector base plate 21 has a first side 22 and a second, opposite side 32. Several fixed contacts 18 which are connected by way of lines 19 with winding taps of a regulating winding of the tapped transformer are arranged on the first side 22. The fixed contacts 18 extend from the first side 22 through the selector base plate 21 to the second side 32. The fixed contacts 18 preferably consist of copper and are, in addition, silvered. Moreover, a first Geneva wheel 25 with a first, movably mounted moved contact 23 is mounted on the first side 22. The first Geneva wheel 25 is mounted on a first bearing axle 26 to be rotatable about an axis 11. The bearing axle 26 is constructed as a separate part mechanically connected with the selector base plate 21. However, the bearing axle can at the time of production of the selector base plate 21 be injection-moulded therewith and constructed together with this as a unit. A first driver 27 is arranged near the first Geneva wheel 25 and is actuated by way of the drive shaft 10 extending through the selector base plate 20. In that case the first driver 27 has a first cam 28 which engages in the first Geneva wheel 25 and in that case rotates this.

When the selector 20 is actuated, the first driver 27 is rotated through 360°. When co-operation with the first Geneva wheel 25 takes place, the first Geneva wheel 25 is rotated only partly for a complete revolution of the first driver 27, thus by a fraction of a complete revolution. By virtue of the combination of the first driver 27 and the first Geneva wheel 25, the continuous rotational movement of the first driver 27 is converted into a stepped or piece-by-piece rotation of the first Geneva wheel 25. The combination of a Geneva wheel and a driver also makes possible even in the rest state, thus prior to or after actuation of the selector, a blocking function of the two parts relative to one another.

Prior to actuation of the first Geneva wheel 25, the first moved contact 23 always contacts one of the fixed contacts 18 and in that case electrically conductively connects this with a connection 29 of a first branch of the diverter switch 40. When the selector 20 is actuated the first Geneva wheel 25 is rotated and in that case switches over the first moved contact 23 from this fixed contact 18 to an adjacent fixed contact 18.

The contacting of each fixed contact 18 takes place on the first side 22 at a first contact region 24 by way of the first moved contact 23.

Figure 3:
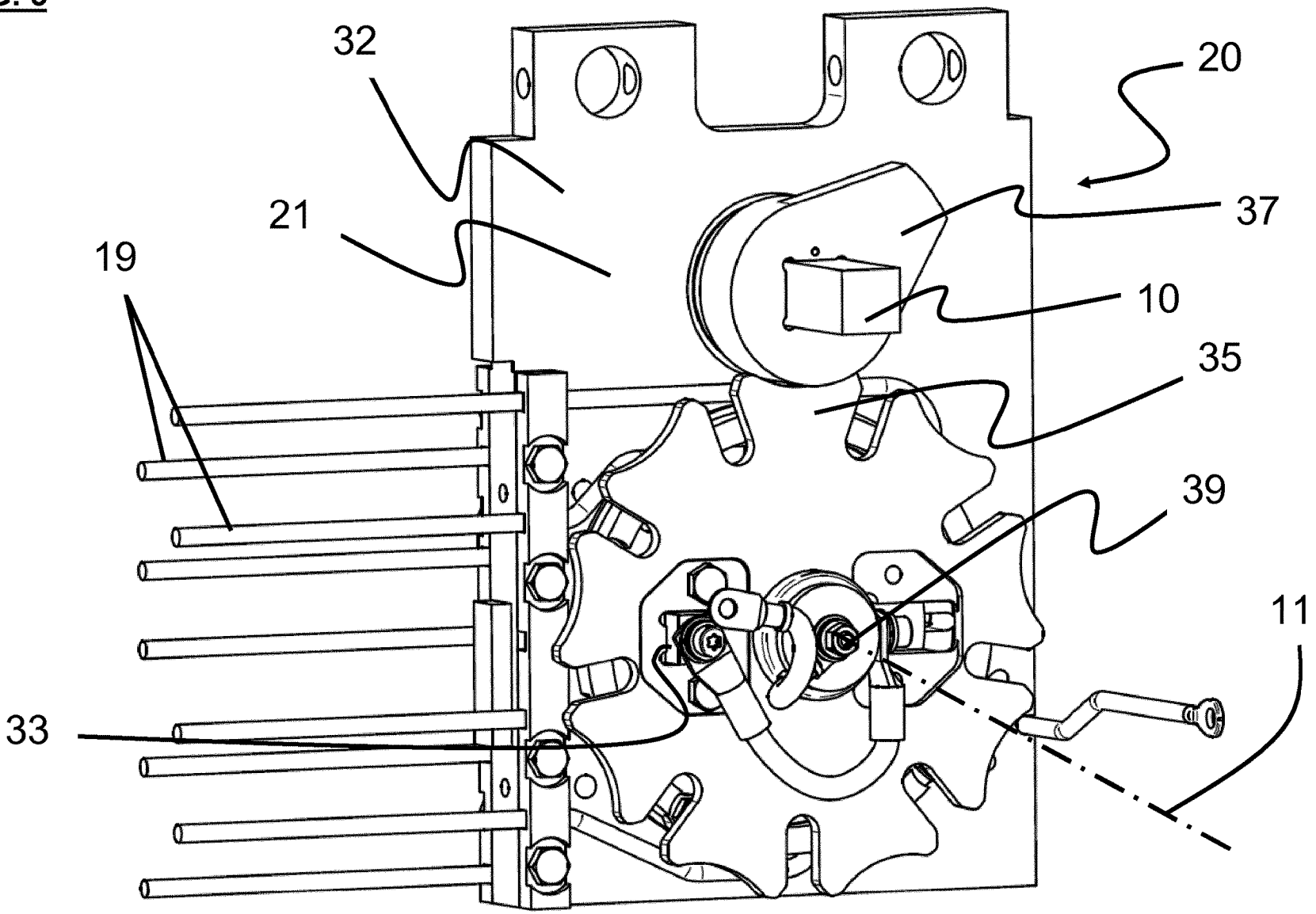
FIG. 3 shows a second side of the selector.

The second side 32 of the selector 20 is illustrated in FIG. 3. Here, too, the fixed contacts 18 are connected by way of lines 19 with winding taps of the regulating winding of the tapped transformer. In addition, a second Geneva wheel 35 with a second moved contact 33 is mounted on the second side 32. The second Geneva wheel 35 is similarly mounted on a second bearing axle 36 to be rotatable about the axis 11. A second driver 37 is arranged near the second Geneva wheel 35 and is actuated by the same drive shaft 10 as the first driver 27. In that case, the second driver 37 has a second cam 38 which engages in the second Geneva wheel 35 and in that case rotates this.

The first cam 28 is arranged to be offset relative to the second cam 38, or the drivers 27, 37 and thus the cams 28, 38 are arranged to be offset. When the drive shaft 10 is rotated, the offset arrangement of the cams 28, 38 or drivers 27, 37 achieves actuation of the Geneva wheels 25, 35 and thus the moved contacts 23, 33 with an offset in time.

Prior to actuation of the second Geneva wheel 35, the second moved contact 33 always contacts one of the fixed contacts 18 and in that case electrically conductively connects this with a connection 39 of a second branch of the diverter switch 40. When the selector 20 is actuated, the second Geneva wheel 35 is rotated and in that case switches over the second moved contact 33 from this fixed contact 18 to an adjacent fixed contact 18. In this form of embodiment the moved contacts 23, 33 contact the same fixed contact 18 before start of the actuation of the selector 20, thus in the stationary state. However, this can vary according to circuitry. The contacting of each fixed contact 18 takes place on the second side 32 at a second contact region 34 by way of the second moved contact 33.

Figure 5:
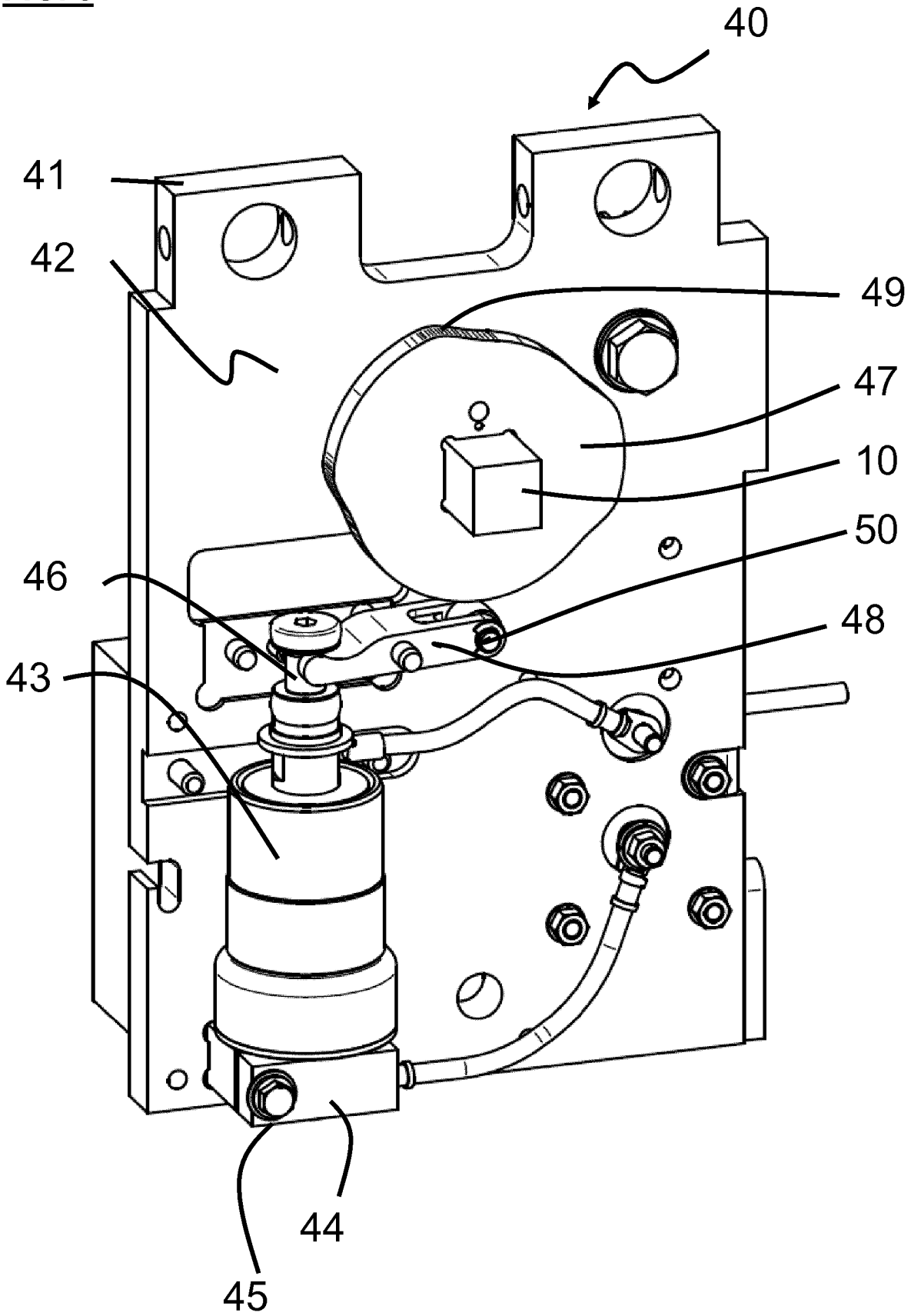
FIG. 5 shows a first side of a diverter switch, which is constructed in accordance with a preferred form of embodiment, of the on-load tap changer.

One of the diverter switches 40, which is constructed in accordance with a preferred form of embodiment, of the on-load tap changer 1 is depicted in FIG. 5. The diverter switch base plate 41 preferably consists of an insulating material such as, for example, plastic or fibre-reinforced plastic (for example, a mixture of polyamide or polyphthalamide with glass fibres) and has a first side 42 and a second, opposite side 52. A vacuum interrupter 43, which is fixed to the load transfer base plate 41 by means of mounts 44, is arranged on the first side 42. The vacuum interrupter 43 includes a fixed contact 45 and a moved contact 46, by way of which the vacuum interrupter 43 is opened or closed. In addition, a cam disc 47 is mounted on the first side 42. A rocker 48 is so rotatably mounted between the cam disc 47 and the moved contact 46 that on rotation of the cam disc 47 one end 50 of the rocker 48 moves off a contour 49 of the cam disc 47 and thereby actuates the vacuum interrupter 43, i.e. closes or opens by way of the moved contact 46 thereof. The moved contact 46 is guided in a mount during the actuation.

Figure 6:
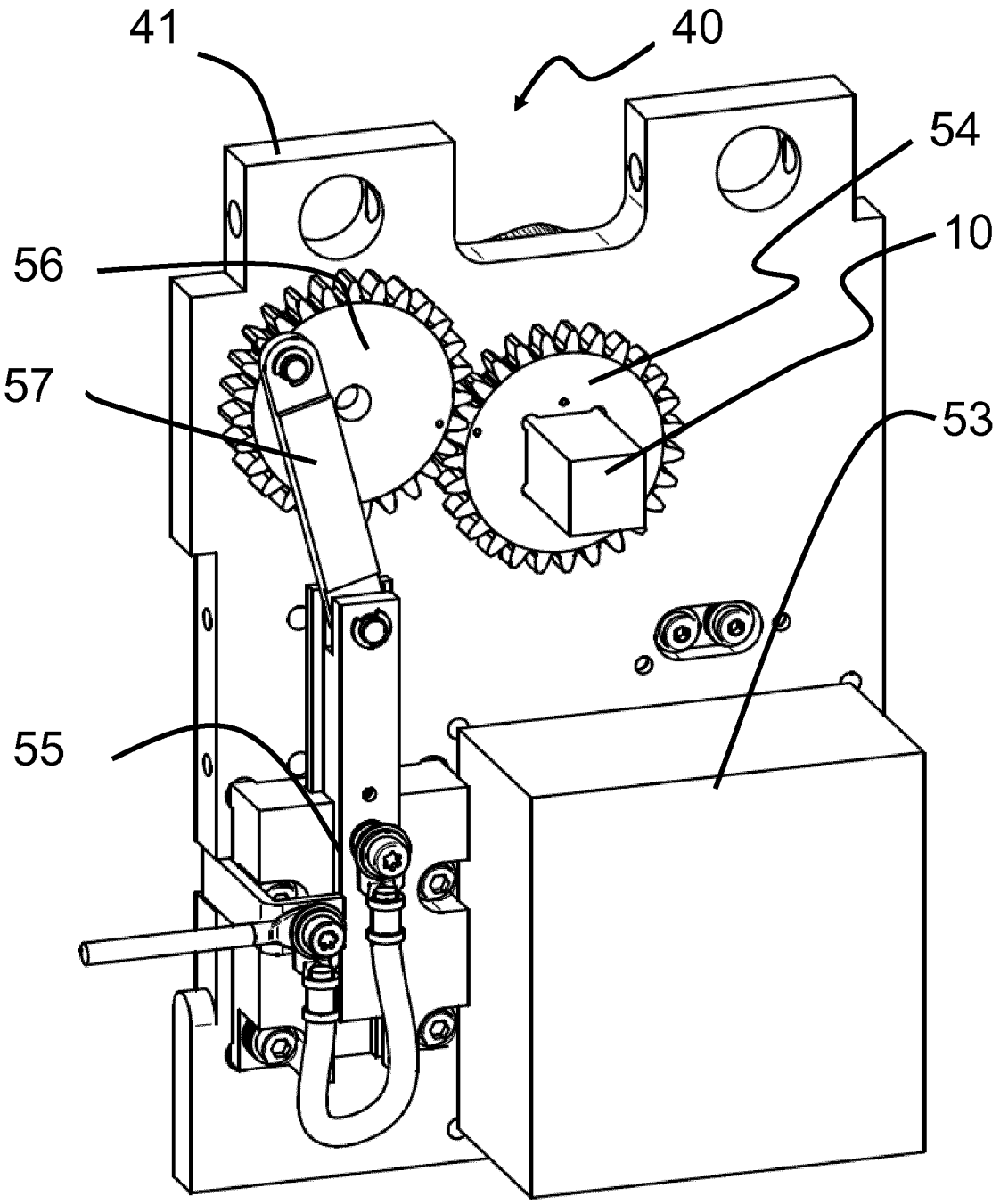
FIG. 6 shows a second side of the diverter switch.

The second side 52 of the diverter switch 40 is illustrated in FIG. 6. A transition resistor 53 is arranged on the second side 52. In addition, a first gearwheel 54, which co-operates with the cam disc 47 on the first side 42, is rotatably mounted on the second side 52. In the example shown here, the drive shaft 10 goes through the cam disc 47, the diverter switch base plate 41 and the first gearwheel 54 and drives the cam disc 47 and the first gearwheel 54. In addition, a switching element 55 which is driven by way of a combination of a second gearwheel 56 and a connecting rod 57 is mounted on the second side 52. The switching element 55 is actuated by way of the individual gearwheels 54, 56 and the connecting rod 57 through actuation of the drive shaft 10. Thus, the rotational movement of the drive shaft 10 is here converted into a linear movement of the switching element 55. The switching element 55 is constructed as a bridging switch. The switching element 55 can also be constructed as a rotary switch.

The arrangement of the individual parts, particularly the vacuum interrupter, the resistor and the switching element, can be distributed on the first and/or second side of the diverter switch base plate according to requirements. In addition, the actuation of the vacuum interrupter and the switching element can take place by way of gearwheels, Geneva wheels and connecting rods.

Figure 7:
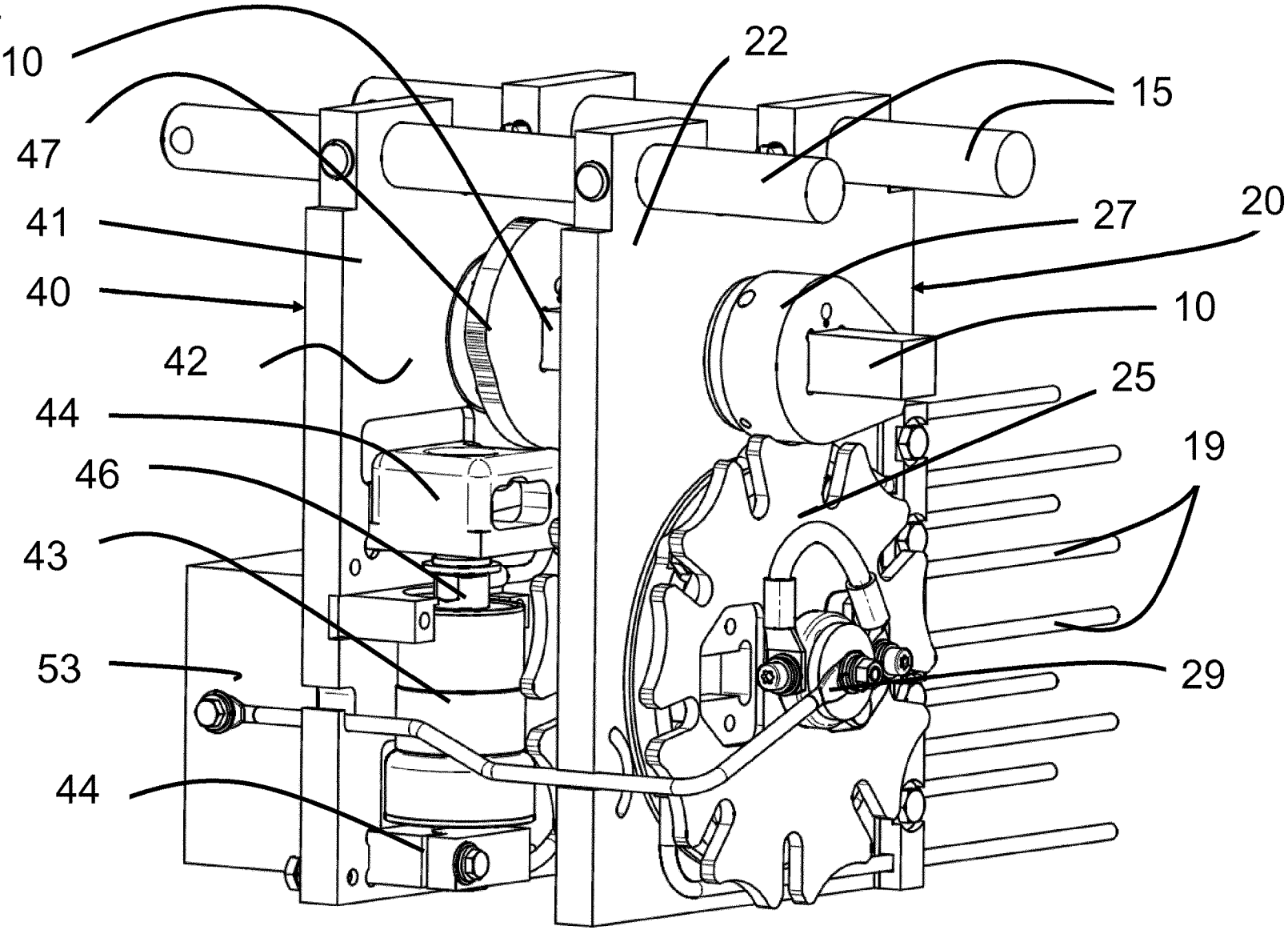
FIG. 7 shows the selector and the diverter switch in assembled state.

The selector 20 and the selector base plate 21 of FIGS. 2 and 3 and the diverter switch 40 and the diverter switch base plate 41 of FIGS. 5 and 6, which are associated with one phase, are illustrated in assembled state in FIG. 7. In that case the selector base plate 21 is connected with the diverter switch base plate 41 by way of two rods 15. The drive shaft 10 extends through the drivers 27, 37, the cam disc 47 and the two base plates 21, 41.

Figure 8:
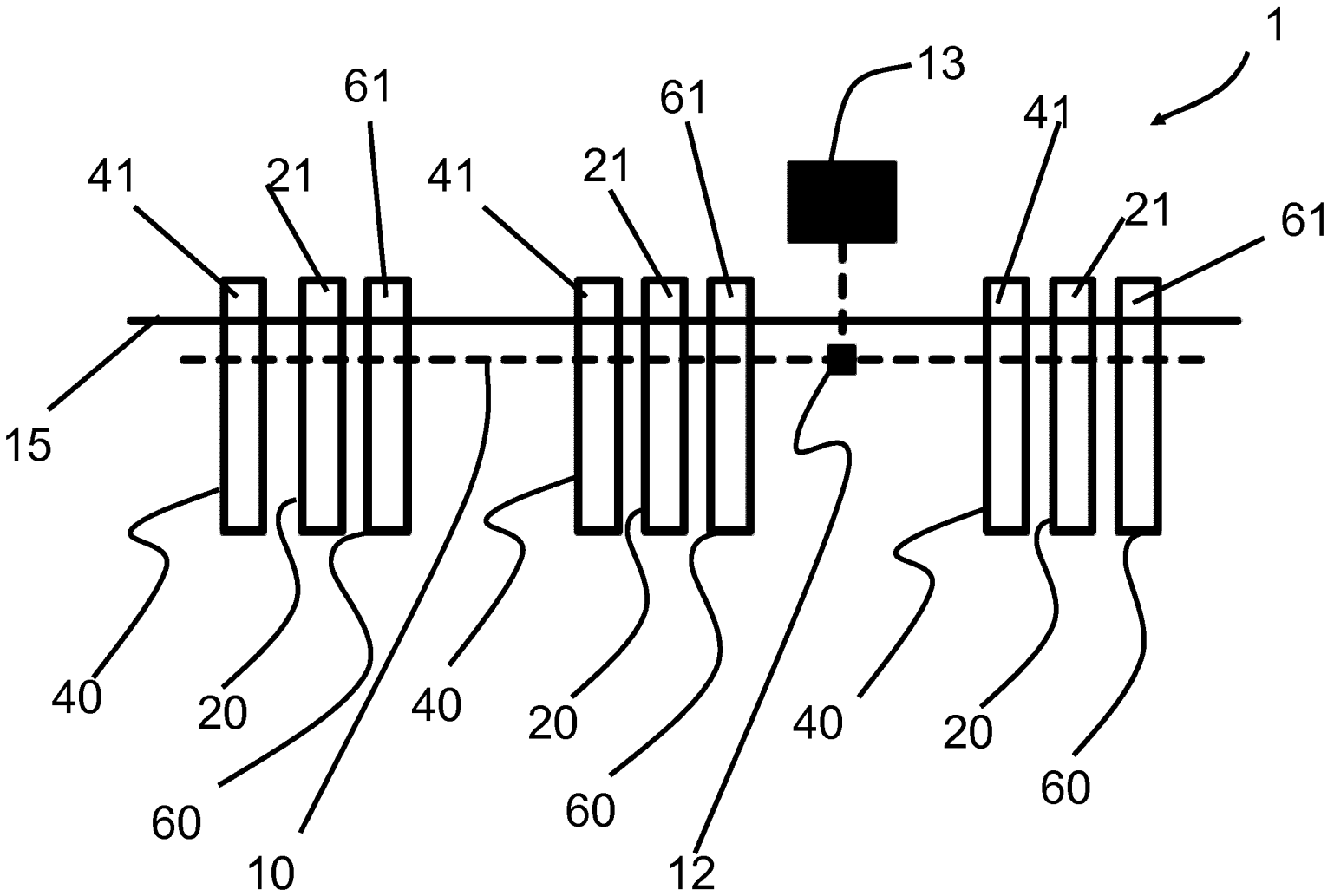
FIG. 8 shows another embodiment of a three-phase on-load tap changer according to the resistor type.

A second form of embodiment of the on-load tap changer 1 is schematically illustrated in FIG. 8. In this form of embodiment the on-load tap changer 1 includes a preselector 60, which is similarly actuated by the common drive shaft 10, for each phase. The preselector 60 serves the purpose of additionally switching a regulating winding of the respective phase in the same sense as or in opposite sense to a corresponding main winding. Each preselector 60 is mounted on a separate preselector base plate 61, but can, according to requirements, also be mounted on the selector base plate 21 or the on-load tap changer base plate 41 of the respective phase. The actuation of the preselector 60 can take place directly by way of the drive shaft 10 or indirectly by way of, for example, a transmission.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The following is a list of reference numerals used herein:

1 on-load tap changer
10 drive shaft
11 axis
12 bevel transmission
13 motor
15 rod
18 fixed contact
19 lines
20 selector
21 selector base plate
22 first side of 21
23 first moved contact
24 first contact region
25 first Geneva wheel
26 first bearing axle
27 first driver
27 first cam
29 connection of 40
32 second side of 21
33 second moved contact
34 second contact region
35 second Geneva wheel
36 second bearing axle
37 second driver
38 second cam
39 connection of 40
40 diverter switch
41 diverter switch base plate
42 first side of 41
43 vacuum interrupter
44 mount
45 fixed contact of 43
46 moved contact of 43
47 cam disc
48 rocker
49 contour
50 end
52 second side of 41
53 transition resistor
54 first gearwheel
55 switching element
56 second gearwheel
57 connecting rod
60 preselector
61 preselector base plate

The invention claimed is:

1. An on-load tap changer of a resistor type, the on-load tap changer comprising:
- a selector base plate;
- a selector mounted on the selector base plate;
- a diverter switch base plate;
- a diverter switch mounted on the diverter switch base plate and comprising a transition resistor; and a common drive shaft which is configured to actuate the selector and the diverter switch;
- wherein the diverter switch base plate and the selector base plate are separate and the selector and the diverter switch are physically separate subassemblies.

2. The on-load tap changer according to claim 1, further comprising:
- a first driver on a first side of the selector base plate; and
- a second driver on a second side of the selector base plate, the second side being opposite the first side, wherein:
- the drive shaft actuates the first driver and the second driver.

3. The on-load tap changer according to claim 1, further comprising:
- a cam disc on a first side of the diverter switch base plate; and
- a first gearwheel on a second side of the diverter switch base plate, the second side being opposite the first side, wherein:
- the drive shaft is configured to actuate the cam disc and the first gearwheel.

4. The on-load tap changer according to claim 1, further comprising a vacuum interrupter, which has a fixed contact and a movable contact, on the first side of the diverter switch base plate, wherein:
- a rocker is arranged between the movable contact and the cam disc; and
- the movable contact of the vacuum interrupter is configured to be actuated by the rocker through rotation of the cam disc.

5. The on-load tap changer according to claim 1, further comprising:
- the transition resistor and a switching element on the second side of the diverter switch base plate; and
- a second gearwheel, which has a connecting rod, between a first gearwheel and the switching element, wherein:
- the switching element is configured to be actuated by the second gearwheel and the connecting rod through rotation of the first gearwheel.

6. The on-load tap changer according to claim 1, further comprising two further selectors and two further diverter switches; wherein:
- the drive shaft drives the selector and the diverter switch.

7. The on-load tap changer according to claim 1, further comprising a preselector for each selector and diverter switch, the preselector being mounted on a preselector base plate or on the respective selector base plate or on the respective diverter switch base plate and is configured to be actuated by the drive shaft.

8. The on-load tap changer according to claim 7, further comprising a rod mechanically connecting the selector base plates, the diverter switch base plates and the preselector base plates together.

9. An on-load tap changer of a resistor type, the on-load tap changer comprising:

a selector base plate;

a selector mounted on the selector base plate;

a diverter switch base plate;

a diverter switch mounted on the diverter switch base plate and comprising a transition resistor;

a common drive shaft which is configured to actuate the selector and the diverter switch;

a first Geneva wheel on the first side of the selector base plate;

a second Geneva wheel on the second side of the selector base plate;

a plurality of fixed contacts on the first side and the second side of the selector base plate;

a first movable contact which is mechanically connected with the first Geneva wheel and which can be selectably connected with each of the fixed contacts on the first side; and a second movable contact which is mechanically connected with the second Geneva wheel and which can be selectably connected with each of the fixed contacts on the second side.

10. The on-load tap changer according to claim 9, wherein the fixed contacts extend from the first side through the selector base plate to the second side.

* * * * *